US007588237B2

(12) United States Patent
Fijnvandraat

(10) Patent No.: US 7,588,237 B2
(45) Date of Patent: Sep. 15, 2009

(54) APPARATUS AND METHOD FOR COLLECTING SHEETS INTO SETS

(75) Inventor: Hendrik Cornelis Fijnvandraat, Enschede (NL)

(73) Assignee: NEOPOST Technologies, Bagneux (FR)

( * ) Notice: Subject to any disclaimer, the term of this patent is extended or adjusted under 35 U.S.C. 154(b) by 21 days.

(21) Appl. No.: 11/480,283

(22) Filed: Jun. 30, 2006

(65) Prior Publication Data

US 2007/0158892 A1 Jul. 12, 2007

(30) Foreign Application Priority Data

Jun. 30, 2005 (NL) ..... 1029387

(51) Int. Cl.
*B65H 5/00* (2006.01)

(52) U.S. Cl. ..... 270/52.16; 270/52.14; 270/52.19; 270/52.22

(58) Field of Classification Search ..... 270/52.14, 270/52.16, 52.19, 52.22
See application file for complete search history.

(56) References Cited

U.S. PATENT DOCUMENTS 3,989,234 A 11/1976 Watkiss ..... 270/58
4,077,181 A * 3/1978 Asher et al. ..... 53/500
4,972,655 A 11/1990 Ogawa ..... 53/155
5,088,711 A * 2/1992 Newsome ..... 270/52.14
5,624,108 A * 4/1997 Kubo ..... 271/9.12
6,257,566 B1 * 7/2001 Dooley ..... 270/52.18
2005/0184441 A1 * 8/2005 Munneke ..... 270/52.14

FOREIGN PATENT DOCUMENTS

DE 198 29 484 C1 11/1999
EP 1 550 628 A1 7/2005
WO WO 0001496 1/2000

* cited by examiner

*Primary Examiner*—Gene Crawford
*Assistant Examiner*—Leslie A Nicholson, III
(74) *Attorney, Agent, or Firm*—Sughrue Mion, PLLC

(57) ABSTRACT

An apparatus for collecting sheets into sets, having a main supply station (16) and at least two insert supply stations (17-20). A first one of the insert supply stations (17-19) is arranged for supplying sheets to a first position on a conveyor track (5) and a second one of the insert supply stations (18-20) is arranged for supplying sheets to a second position on the conveyor track (5) downstream of the first position on the conveyor track (5). The insert supply stations (17-20) each comprise a stacking position (46) arranged for collecting sheets, received piece by piece, into a stacked set and for feeding the set. At least the sheet supply track (6, 53-57) of the second insert supply station is provided with a waiting position, which is arranged for receiving a set coming from the stacking position (46) and holding the received set in readiness while in the stacking position (46) a next set (2) is being collected.

7 Claims, 3 Drawing Sheets

APPARATUS AND METHOD FOR COLLECTING SHEETS INTO SETS

CROSS-REFERENCE TO RELATED APPLICATIONS

This application claims priority from Dutch Patent Application No. NL 1029387, filed on Jun. 30, 2005.

FIELD AND BACKGROUND OF THE INVENTION

The invention relates to an apparatus and a method for collecting sheets into sets.

In particular, in the context of machine assembly of mail items, it is known to use an apparatus having:

a main supply station equipped with a sheet holder for storing a stack of sheets, a separation system for separating sheets piece by piece from the sheet holder, and a sheet supply track for conveying separated sheets to the conveyor track; and at least two insert supply stations, each equipped with a sheet holder for storing a stack of sheets, a separation system for separating sheets piece by piece from the sheet holder, and a sheet supply track for conveying separated sheets to the conveyor track.

A first one of the insert supply stations is then equipped for supplying sheets to a first position on the conveyor track downstream of the main supply station and a second one of the attachment supply stations is arranged for supplying sheets to a second position on the conveyor track downstream of the first position on the conveyor track.

The sheets can be, for instance, address carriers, letters, brochures, reply cards, prepaid envelopes, carriers with a plastic card, etc.

In practice, it frequently happens that in assembling very large numbers of sets, for the purpose of supplying inserts to main documents coming from the main supply station, a switch is made from one of the insert supply stations to another one of the insert supply stations, both insert supply stations being initially loaded with inserts of the same type.

In order to prevent loss of production, it is desirable that this can be done automatically and without stopping the apparatus, in response to (imminent) emptiness of the insert supply station from which inserts are being added. A problem here is that if the insert supply station that is to take over the supply of documents from an emptied insert station is situated upstream of the emptied insert station, there is at least one main document or at least one set of main documents to which no insert document can be added without stopping the machine and executing such addition manually. This is disadvantageous in particular if the main documents, as is often the case, are each unique documents destined for a particular recipient.

SUMMARY OF THE INVENTION

It is an object of the invention, in the processing of sheets into mail items, to provide a solution which makes it possible, during the processing of main documents with sets of inserts into mail items, without stopping, to switch from the supply of sets of inserts from one of the insert supply stations to the feeding of sets of inserts from another one of the insert supply stations, also when the latter is situated upstream of the emptied one of the insert supply stations.

According to the present invention, this object is achieved by providing an apparatus for collecting sheets into sets, equipped with a conveyor track, a main supply station having a sheet holder for storing a stack of sheets, a separation system for separating sheets piece by piece from the sheet holder, and a sheet supply track for conveying separated sheets to the conveyor track, and at least two insert supply stations, each having a sheet holder for storing a stack of sheets, a separation system for separating sheets piece by piece from the sheet holder, and a sheet supply track for conveying separated sheets to the conveyor track.

A first one of the insert supply stations is arranged for supplying sheets to a first position on the conveyor track downstream of the main supply station and a second one of the insert supply stations is arranged for supplying sheets to a second position on the conveyor track downstream of the first position on the conveyor track.

The sheet supply tracks of the insert supply stations each have a stacking position arranged for collecting sheets received piece by piece into a stacked set and for feeding the set.

The sheet supply tracks of the insert supply stations are each arranged for adding to a sheet or to a set of sheets coming from the main supply station at least one set of sheets.

At least the sheet supply track of the second insert supply station has a waiting position which is arranged for receiving a set coming from the stacking position and holding the received set in readiness while in the stacking position a next set is being collected.

A control is arranged for, in response to lack of a complete, feedable set in the stacking position of the second insert supply station, causing a set to be added from the first insert supply station to a main document.

The invention can also be embodied in a method which can be carried out with such apparatus, for collecting sheets into sets, utilizing: a conveyor track; a main supply station having a sheet holder for storing a stack of sheets, a separation system for separating sheets piece by piece from the sheet holder, and a sheet supply track for conveying separated sheets to the conveyor track; and at least two insert supply stations, each having a sheet holder for storing a stack of sheets, a separation system for separating sheets piece by piece from the sheet holder, and a sheet supply track for conveying separated sheets to the conveyor track.

Each time, a first one of the insert supply stations supplies sheets to a first position on the conveyor track downstream of the main supply station and a second one of the insert supply stations supplies sheets to a second position on the conveyor track downstream of the first position on the conveyor track.

The sheet supply tracks of the insert supply stations each in a stacking position collect sheets, received piece by piece, into a stacked set and feed it.

The sheet supply tracks of the insert supply stations add to a sheet or to a set of sheets coming from the main supply station at least one set of sheets.

In a waiting position in the sheet supply track of the second insert supply station, a set of sheets coming from the stacking position is received and held in readiness while in the stacking position a next set of sheets is collected.

In response to lack of a complete, feedable set in the stacking position of the second insert supply station, from the first insert supply station a set of sheets is added to a main document.

As at least the sheet supply track of the second insert supply station comprises a waiting position, which is arranged for receiving a set coming from the stacking position and holding the received set in readiness while in the stacking position a next set is being collected, and the apparatus is arranged for, in response to the lack of a complete feedable set in the stacking position of the second insert supply station, adding to a main document a set from the first insert supply station, there is, at the moment when it is detected that no complete set is available in the stacking position, still a set available in the waiting position which can still be added to a main document which has already been conveyed too far to receive a set of inserts from the first one of the insert supply stations. It is noted that the designations 'first' and 'second' for the insert supply stations are not intended to indicate that there can be only two insert supply stations or that they should specifically be the first and second insert supply stations if there are more than two insert supply stations. The point is merely to distinguish the insert supply stations from each other as regards their relative positions, while more insert supply stations may be present in the apparatus.

Particular elaborations of the invention are set forth in the dependent claims.

These and further features as well as effects and details of the invention will be described hereinbelow and elucidated with reference to an exemplary embodiment represented in the Figures.

DETAILED DESCRIPTION

Figure 1:
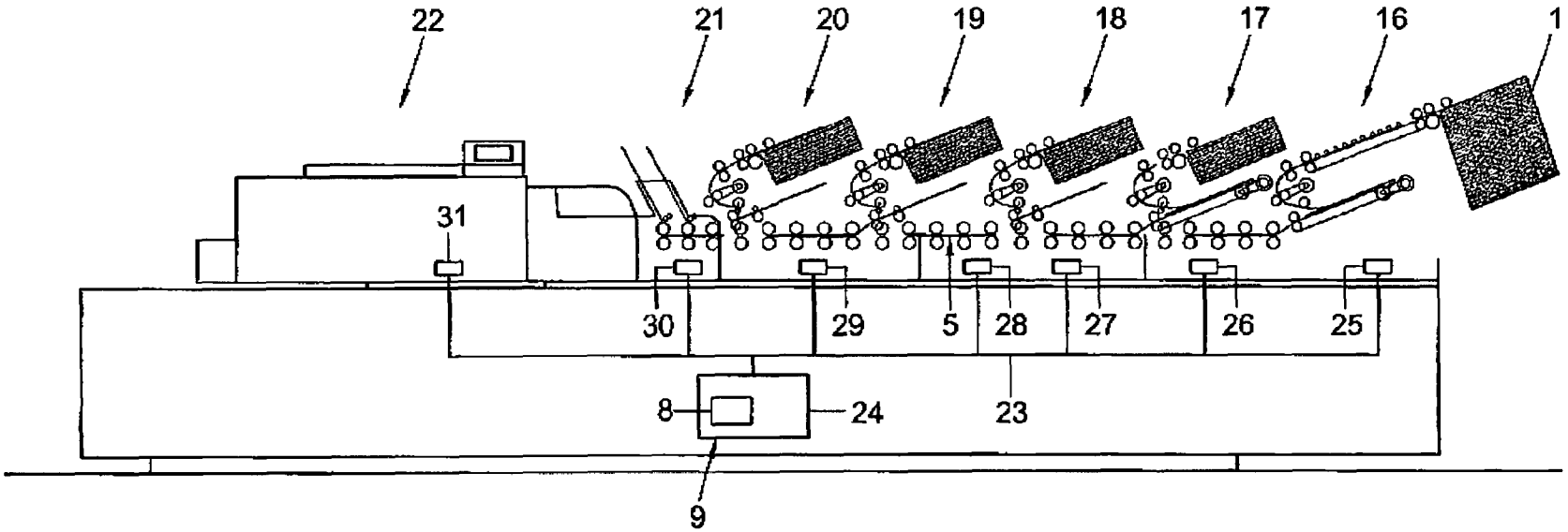
FIG. 1 is a schematic representation of an example of an apparatus according to the invention.
Figure 2:
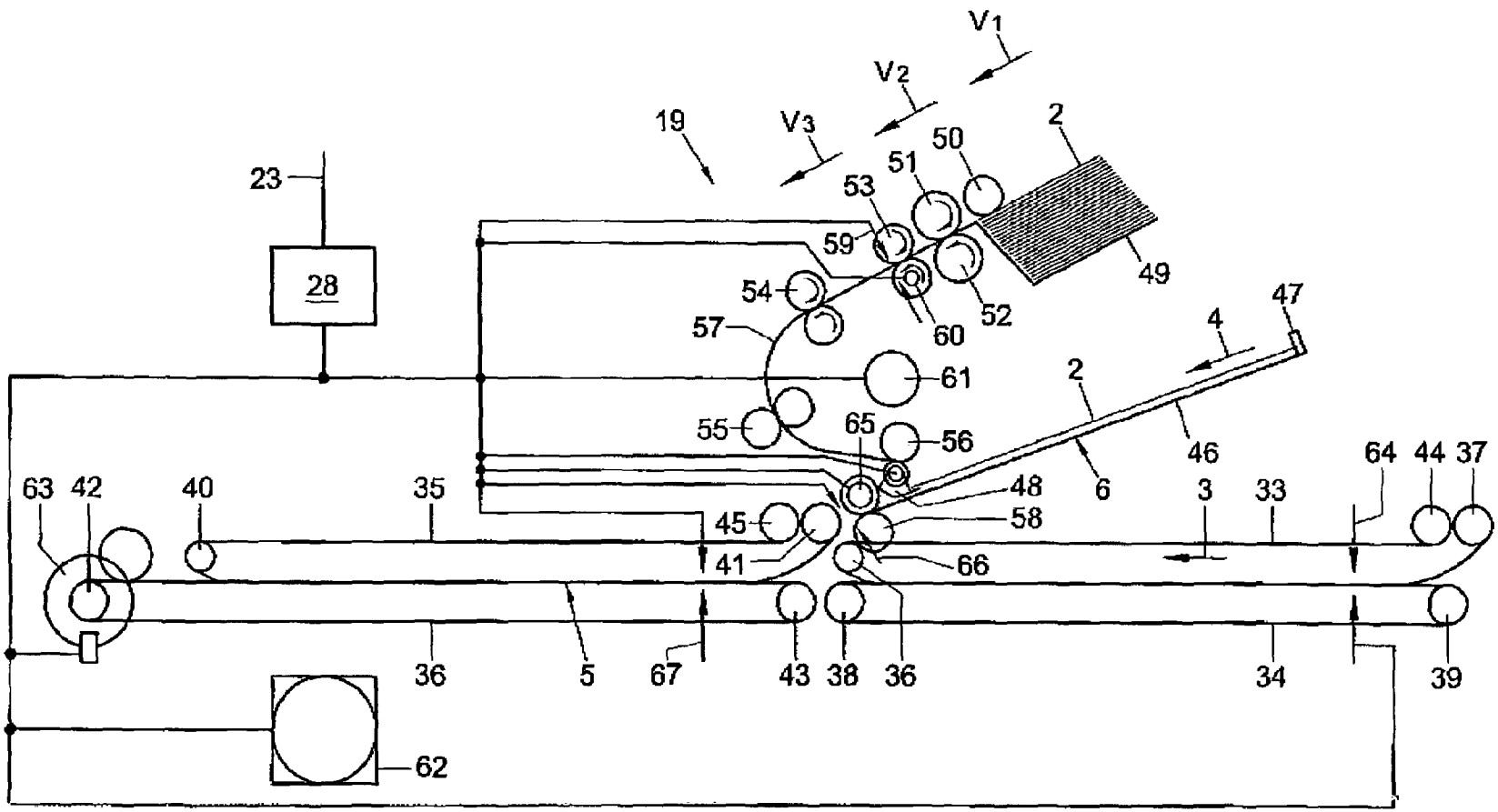
FIG. 2 is a schematic representation of a portion of the apparatus according to FIG. 1.

The apparatus for assembling mail items according to the example represented in FIGS. 1 and 2 is equipped with a supply station 16 for supplying main documents, insert supply stations 17-20 for supplying inserts, a folding station 21 and an inserter station 22. A transport track 5 extends from the supply station 16 for supplying main documents to the inserter station 22. The control structure 9 comprises a main control unit 24 with a memory 8 and a connecting structure 23 which operatively connects the main control unit 24 with the stations 16-22, as is schematically represented in FIG. 1. The stations are equipped with distributed control units 25-31 for processing instructions coming from the main control unit 24 and for delivering signals representing the status of the respective station 16-22. According to this example, the supply stations 16-20 are each suitable for feeding multiple sheets to each set.

The sheets 1, 2 to be processed can for instance be of a different size.

The sheet 1 can for instance be of A4 size and a set of sheets 2 can for instance be 12 cm long, measured in conveying direction 4.

The sheets 1, 2 are conveyed in conveying directions 3 and 4, respectively, along the conveyor track 5 and a supply track 6.

Next, at least the sheet 1 or the set of sheets 2 is stopped, until the relative positions of the sheets 1, 2 are suitable for combining the sheets 1, 2 is to a stacked set in the conveyor track 5 and then the sheets 1, 2 are simultaneously conveyed further and combined to a stacked set According to this example, in the folding station 21, the stacked set is folded twice to form a zigzag structure.

The sheets 1, 2 of the set 7 are then, from the combining until the folding of the set 7, mutually fixed. In folding, a first fold 14 is provided in all sheets 1, 2 of the set 7 and a second fold 15 is provided only in the sheet 1.

FIG. 2 shows the insert supply station 19 of the apparatus according to FIG. 1 in more detail. The conveyor track 5 for conveying sheets 1 is designed with pairs of opposite sets of conveyor belts 33, 34: 35, 36. The conveyor belts are each tensioned around end rollers 36-44. Tension rollers 44, 45 serve for tensioning the upper conveyor belts 33, 35. The opposite sets of conveyor belts 33, 34, 35, 36 operatively ensure that sheets of sets being conveyed between them are mutually fixed in a reliable manner.

The supply track 6 converging with the conveyor track 5 is determined by a collecting platform 46 with an end stop 47 whose position is adjustable, a movable stop 48 and a pair of conveyor rollers 58 located downstream thereof.

For collecting a set of sheets 2 on the collecting platform 46, means are provided for piece by piece supplying sheets 2 from a stock. For this, many possible solutions are known from the state of the art. According to this example, the means for piece by piece supplying sheets from a stock comprise a sheet holder 49, a supply roller 50 for supplying sheets, a conveyor roller 51 and a separation roller 52 for conveying and, if necessary, separating sheets 2 supplied by the supply roller 50, two sets of conveyor rollers 53, 54, 55, 56 for conveying separated sheets, whether or not at increasing speeds v1, v2, v3, and a diagrammatically represented system of guides 57.

In cooperation with a passage between the upstream one 33 and the downstream one 35 of the upper conveyor belts 33, 35, the nip between the pair of conveyor rollers 58 downstream of the collecting platform forms the connection of the sheet supply track, formed by the supply track 6, the rollers 53-56 and the guide 57, to the conveyor track 5 for combining sheets 1, 2, supplied via conveyor track 5 and supply track 6, to a stacked set 7.

For controlling the transport of the sheets 2, the means for supplying sheets 2 to the sheet platform 46 comprise a first insert detector 59 for detecting the presence of a sheet 2 directly downstream of the nip between the conveyor roller pair 53. A coupling 60 operates the drive of the conveyor rollers 50, 51 and 53 upstream of the detector 60 by coupling or uncoupling the conveyor rollers 50, 51 and 53 upstream of the detector 60 with or from a motor/pulse disc assembly 61, while the local control unit 28 is arranged for controlling the coupling for stopping sheets in a waiting position with a leading edge shortly beyond the first insert detector 59 and for driving the conveyor rollers 50, 51 and 53 upstream of the detector 60, until the detector has detected and signaled the presence of a leading edge of a next sheet 2.

The central control unit 24 is arranged for determining the folding length or folding lengths $\alpha$ of the set 7 to be folded and for storing data representing the size of the sheets 2 of the second, smaller size in the memory 8. Further, the central control unit 24 is arranged for, in response to a difference between the folding length or folding lengths $\alpha$ and the size of the second sheet that is within a predetermined range, signaling to the respective distributed control units 26-29 of the insert supply stations 17-20 that, in combining sheets 1 and 2 supplied via tracks 5, 6 into the set 7, leading edges of the sheets 1, 2 are to be positioned at a mutual distance in the conveying direction 3 and trailing edges of the sheets 1, 2 are to be positioned at a mutual distance in the conveying direction 3. In response to what range the central control unit 24 does not position the sheets 2 of the second, smaller size with leading or trailing edges in alignment on the leading and trailing edges, respectively, of the sheets 1 of the first, larger size, depends on the specific properties of the folding station 21 with which the sets 7 are folded.

For controlled positioning of the sheets 2 of the second, smaller size with respect to the sheets 1 of the first, larger size in a position with both leading and trailing edges mutually staggered over (directly or indirectly) predetermined distances in conveying direction, the apparatus according to the example shown is designed as follows.

For driving the conveyor track 5 in the area of the insert supply station 19, a drive structure is provided, of which an electric motor 62 and a pulse disc 63 are parts. Operating means for starting and stopping the first drive structure are formed by the local control unit 28. For this purpose, the latter is provided with a motor control, which can also be part of the drive structure. For detecting at least a leading or trailing edge of a sheet 1 in the conveyor track 5, a track monitoring detector 64 has been placed upstream of the area where the supply track 6 connects to the conveyor track 5.

A second drive structure for driving the supply track 6 is formed by the motor/pulse disc assembly 61 and a second coupling 65 with which the conveyor roller pair 58 downstream of the collecting platform can be coupled with and uncoupled from the motor/pulse disc assembly 61. The local control unit 28 is further arranged for operating the movable stop 48 between a stacking position as represented and a pass position at a slight distance above the supply track 6. The movement to the pass position is executed by moving the stop initially in conveying direction 4 and then rotating it away from the supply track 6. The supply track 6 is thereby cleared for conveying a set of sheets collected on the platform 46. The local control unit 28 is further arranged for starting and stopping the second drive structure, and in particular the conveyor roller pair 58 downstream of the collecting platform 46, by operating the second coupling 65. In this way, the transport of the set of sheets 2 collected on the collecting platform 46 to a waiting position can be controlled. Sets of sheets 2 received in the waiting position can be held in readiness there while on the platform 46 a next set is being collected. According to this example, this is enabled in that the movable stop 48, each time after it has moved to the pass position and the stack of sheets has passed, is moved to the stacking position again while a trailing portion of the set of sheets in the waiting position is still on the collecting platform 46. Thus, in the station 19, simultaneously, two collected sets or sheets can be present, while allowing a compact construction in that a next set of sheets can be collected in a position overlapping the set of sheets in the waiting position.

Figure 3A:
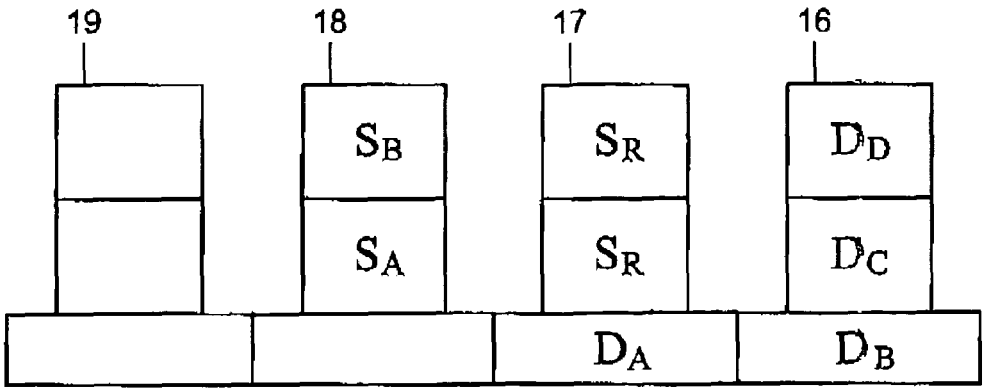
FIGS. 3A-3C are highly schematic representations of three consecutive operating conditions of the apparatus according to the example represented in FIGS. 1 and 2.
Figure 3B:
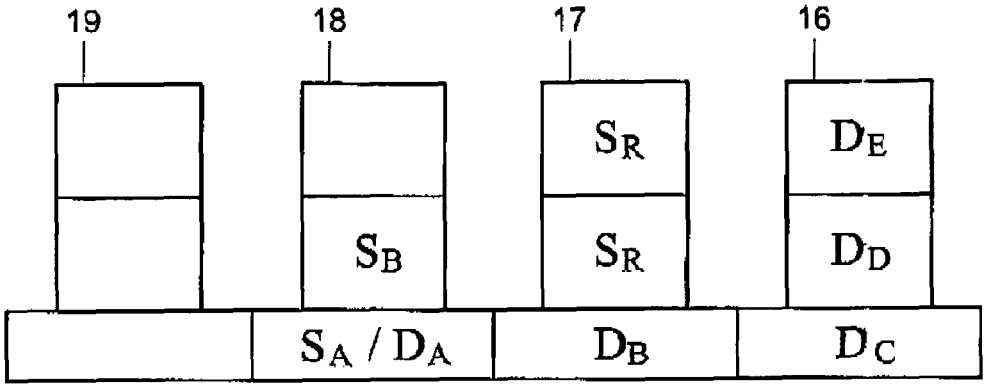
Figure 3C:
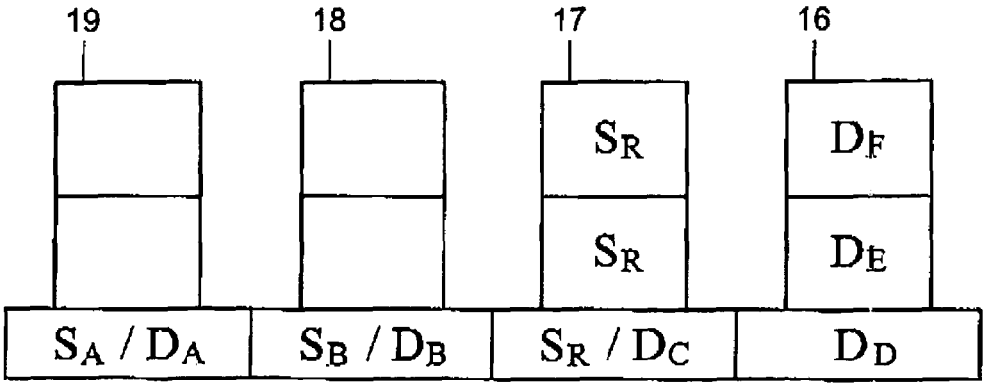

FIGS. 3A-3C illustrate how, owing to at least the sheet supply track of the second insert supply station 18 including a waiting position, which is arranged for receiving a set coming from the stacking position and holding the received set in readiness while in the stacking position a next set is being collected, and owing to the apparatus being arranged for, in response to the lack of a complete, feedable set in the stacking position of the second insert supply station 18, adding to a main document a set Sri from the first attachment supply station 17 at the moment when it is detected that no complete set is available in the stacking position in the second insert supply station 18, still a set SB is available in the waiting position which can still be added to a main document LAB which has already been conveyed too far to receive a set of inserts from the first one of the insert supply stations 17. The same principle is also applicable by feeding an insert set from the second insert supply station 18 in response to the lack of an insert set in the stacking position in the third insert supply station 19.

A second insert detector 66 (FIG. 2) for detecting at least one leading or trailing edge of a set of sheets 2 or a single sheet in the supply track 6 is located just downstream of the conveyor roller pair 58 downstream of the collecting platform 46.

The local control unit 28 is arranged for clearing the supply track 6 and for controlling the second coupling 65 for starting the drive of the supply track 6 by coupling and for starting the motor 62 for driving the conveyor track 5. As a result, sheets 1 and 2 are supplied along the tracks 6, 6. The local control unit 28 is further arranged for then, in response to detection of a leading or trailing edge of a set of sheets 2 in the supply track 6, controlling the second coupling 65 for interrupting the drive of the supply track 6 by uncoupling. As a result, the set of sheets 2 in the supply track 6 is stopped in the waiting position. The local control unit 28 is further arranged for then, in response to detection of a leading or trailing edge of a sheet by the detector 64 along the conveyor track 5, controlling the second coupling 65 for restarting the drive of the supply track 6 by recoupling. Because the distances from the detector 64 along the conveyor track 5 and the distance from the second insert detector 66 along the supply track 3 and from the stop 47 to the place where the supply track 6 meets the conveyor track 5 are known, it is possible, by carrying out the restart of the drive of the supply track 6 at a suitable time, to position the set of sheets 2 accurately at any desired position on the first sheet 1.

Downstream of the supply track 6, along the conveyor track 5, a downstream detector 67 is located for detecting the trailing edge 12 of a set 7 collected in the insert supply station 19. The local control unit 28 is arranged for stopping the motor 62 which drives the conveyor track 5 in response to a signal from the detector 67 which indicates the passage of such a trailing edge 12.

In the following table, in successive lines, successive detections and the actions carried out in response thereto are shown:

TABLE 1

| Detection | Action |
|---|---|
| ready signal (for instance coming from downstream station 20) | coupling 65 IN, motor 62 ON |
| leading edge of sheet 2 at detector second insert detector 66 | coupling 65 FREE |
| trailing edge at detector 64 | start pulse counting pulse disc 3 |
| pulse counting has reached | coupling 65 IN |
| predetermined value trailing edge at detector 67 | coupling 65 FREE, motor 62 OFF<br>stop 48 from stacking position via pass position back to stacking position |

The pulse disc 63 thus forms a movement indicator coupled with the local control unit 28 of the control structure 9 for detecting movement in conveying direction by the conveyor track 5. The local control unit 28 is here arranged for restarting the supply track 6 in response to a particular movement signaled by the movement indicator 63, which movement has been chosen such that the sheet 2 of the second size is positioned in the intended position in conveying direction on the sheet 1 of the first size. Although, in view of the greater movements along the conveyor track 5 along which according to this example the sheet 1 which is longer in conveying direction is conveyed, it is preferred to stop or at least decelerate the conveyor track until the intended relative positioning of the sheets 1, 2 has been obtained, it is also possible to stop or decelerate the conveyor track for obtaining the intended relative positions. Also, in principle, it is possible, depending on the conditions, to decelerate or accelerate the conveyor track and/or the supply track for obtaining the intended relative positions of the collected sheets. Further, the insert supply stations may also feed single sheets instead of stacks of sheets.

What is claimed is:

1. An apparatus for collecting sheets into sets, comprising:

a conveyor track;

a main supply station comprising a sheet holder for storing a stack of sheets, a separation system for separating sheets piece by piece from the sheet holder, and a sheet supply track for conveying separated sheets to the conveyor track; and at least two insert supply stations, each comprising a sheet holder for storing a stack of sheets, a separation system for separating sheets piece by piece from the sheet holder, and a sheet supply track for conveying separated sheets to the conveyor track;

wherein a first one of said insert supply stations is arranged for supplying sheets to a first position on the conveyor track downstream of the main supply station and wherein a second one of said insert supply stations is arranged for supplying sheets to a second position on the conveyor track downstream of said first position on the conveyor track;

wherein the sheet supply tracks of said insert supply stations each comprise a stacking position arranged for stacking sheets received piece by piece along the supply track into a stacked set and for feeding the stacked set;

wherein at least the sheet supply track of said second insert supply station comprises a waiting position, which is arranged for receiving a stacked set coming from the stacking position, holding the received stacked set in readiness while a next set is being stacked in the stacking position and adding the received stacked set to a main document in the conveyor track while the next stacked set is being held in the stacking position;

wherein the sheet supply tracks of said insert supply stations are each arranged for adding to a sheet or to a set of sheets coming from the main supply station at least one stacked set; and further comprising a control arranged for, in response to a lack of a complete, feedable stacked set in the stacking position of said second insert supply station, causing a stacked set to be added from said first insert supply station to a main document.

2. An apparatus according to claim 1, wherein the stacking position is bounded by a stop which is operatively movable between a pass position for passing a sheet or a stack of sheets and a collecting position for collecting sheets against it, the stop in said collecting position leaving space clear for a sheet or a set of sheets which is still partly in the stacking position.

3. An apparatus according to claim 2, further comprising a second stop at an adjustable distance from the movable stop.

4. An apparatus according to claim 3, wherein the sheet supply track of said second insert supply station has a portion which terminates above said movable stop and opposite said second stop.

5. A method for collecting sheets into sets, comprising:

providing a conveyor track;

providing a main supply station comprising a sheet holder for storing a stack of sheets, a separation system for separating sheets piece by piece from the sheet holder, and a sheet supply track for conveying separated sheets to the conveyor track;

providing at least two insert supply stations, each comprising a sheet holder for storing a stack of sheets, a separation system for separating sheets piece by piece from the sheet holder, and a sheet supply track for conveying separated sheets to the conveyor track;

a first one of said insert supply stations supplying sheets to a first position on the conveyor track downstream of the main supply station and a second one of said insert supply stations supplying sheets to a second position on the conveyor track downstream of said first position on the conveyor track;

collecting and stacking sheets, received piece by piece along the sheet supply tracks of the respective insert supply stations, into a stacked set in a stacking position in the respective sheet supply track;

receiving a stacked set of sheets coming from the stacking position in a waiting position in the sheet supply track of said second insert supply station, holding the received stacked set in readiness while a next set of sheets is stacked in the stacking position and adding the received stacked set to a main document in the conveyor track while the next set is being held in the stacking position;

the sheet supply tracks of said insert supply stations adding at least one stacked set to a sheet or to a set of sheets coming from the main supply station; and in response to a lack of a complete, feedable stacked set in the stacking position of said second insert supply station, adding a stacked set from said first insert supply station to a main document.

6. A method according to claim 5, further comprising moving a stop which bounds the stacking position between a pass position for passing a sheet or a stack of sheets and a collecting position for collecting sheets against it in the stacking position, wherein the stop in said collecting position leaves space clear for a sheet or a set of sheets in said waiting position which sheet or stack of sheets is partly in the stacking position.

7. A method according to claim 6, wherein sheets are collected against a second stop at an adjustable distance from the movable stop.

* * * * *

UNITED STATES PATENT AND TRADEMARK OFFICE

CERTIFICATE OF CORRECTION

PATENT NO. : 7,588,237 B2
APPLICATION NO. : 11/480283
DATED : September 15, 2009
INVENTOR(S) : Hendrik Cornelis Fijnvandraat It is certified that error appears in the above-identified patent and that said Letters Patent is hereby corrected as shown below:

Title Page

(73) Assignee: Delete "NEOPOST TECHNOLOGIES" and insert --NEOPOST S.A.--

Signed and Sealed this
Twenty-ninth Day of March, 2011

David J. Kappos

David J. Kappos
*Director of the United States Patent and Trademark Office*